United States Patent [19]

Kubo et al.

[11] Patent Number: 4,929,981

[45] Date of Patent: May 29, 1990

[54] DEVELOPING APPARATUS

[75] Inventors: Takahiro Kubo, Tokyo; Hatsuo Tajima, Matsudo, both of Japan

[73] Assignee: Canon Kabushiki Kaisha, Tokyo, Japan

[21] Appl. No.: 210,250

[22] Filed: Jun. 23, 1988

[30] Foreign Application Priority Data

Jun. 29, 1987 [JP] Japan ..... 62-159714

[51] Int. Cl.[5] ..... G03G 15/09

[52] U.S. Cl. ..... 355/253; 118/658

[58] Field of Search ..... 355/253, 251; 118/657, 118/658

[56] References Cited

U.S. PATENT DOCUMENTS

| | | | |
|---|---|---|---|
| 3,923,034 | 1/1976 | Takahashi | 355/3 |
| 4,174,903 | 11/1979 | Snelling | 118/657 |
| 4,185,916 | 1/1980 | Miller et al. | 118/657 X |
| 4,548,489 | 10/1985 | Yoshikawa | 355/3 |

FOREIGN PATENT DOCUMENTS

| | | | |
|---|---|---|---|
| 2136696 | 1/1972 | Fed. Rep. of Germany . | |
| 57-188048 | 11/1982 | Japan | 118/658 |
| 1223741 | 3/1971 | United Kingdom | 355/253 |
| 1360224 | 7/1974 | United Kingdom . | |

*Primary Examiner*—Joan H. Pendegrass
*Attorney, Agent, or Firm*—Fitzpatrick, Cella, Harper & Scinto

[57] ABSTRACT

A developing apparatus wherein a magnet is stationarily disposed within a sleeve for carrying a developer. Adjacent an outer periphery of the magnet, only two magnetic poles having different polarities. They are diametrically opposed with respect to a center of the sleeve. One of the magnetic poles form a magnetic field in the developing zone, whereas the other magnetic pole forms a magnetic field in the zone for regulating the thickness of the layer of the developer on the sleeve.

9 Claims, 2 Drawing Sheets

DEVELOPING APPARATUS

FIELD OF THE INVENTION AND RELATED ART

The present invention relates to a developing apparatus for developing a latent image, particularly an electrostatic latent image formed through an electrophotographic process or an electrostatic recording process.

In conventional developing devices, as shown in FIG. 1, a rotatable developer carrying member 2, which will hereinafter be called "developing sleeve", is disposed, for rotation in a direction indicated by an arrow B, close to a cylindrical electrostatic latent image bearing member 1, which will hereinafter be called "photosensitive drum" which is rotatable in the direction indicated by an arrow A. The developing sleeve 2 is in the form of a cylinder, having, for example, an outer diameter of not less than approximately 16 mm and a thickness of 0.75 mm. The developing sleeve 2 is disposed in an opening of a developer container 3 containing a developer 5, the opening being adjacent to the photosensitive drum. In this manner, a developing zone 7 is established at a position where the developing sleeve 2 is close to the photosensitive drum 1. Inside the developing sleeve 2, there is disposed a columnar magnet 4 having a number of magnetic poles, which functions as magnetic field generating means which is stationary (not rotatable). The magnet 4 is a permanent magnet or electromagnet having two couples of magnetic poles N1 and S1, and N2 and S2 which are equidistantly disposed in the circumferential direction. The magnet 4 produces magnetic lines of force in the space adjacent the outer periphery of the developing sleeve 2, by which a one component developer 5, for example, mainly containing magnetic toner particles usable with a jumping developing method is carried on the outer surface of the developing sleeve 2. The developer 5 supplied on the outer surface of the developing sleeve 2 in the container 5 is regulated in its layer thickness. The regulating member 6 is disposed opposed to the developing sleeve 2 with a predetermined gap S at a position upstream of the developing zone 7 with respect to the rotational direction B of the developing sleeve 2, more particularly the position where the magnetic pole N1 is opposed, in the shown example.

The developer 5, on the developing sleeve 2 having been subjected to the regulating function of the regulating member 6, is conveyed to the developing zone 7, where it is supplied to the photosensitive drum 1 to visualize the electrostatic latent image thereon.

However, if an attempt is made to provide a large magnetic force for the purpose of obtaining a good quality of the image with the magnet having a number of poles, the diameter of the magnet is required to be large, with the result that reduction of the size of the apparatus becomes difficult, and simultaneously, the cost of the apparatus increases.

More particularly, if the magnetic force provided by the magnet is small, it is difficult to form a developer layer having a proper thickness, by the regulating member 6, and also, the erection of the chains of the developer is insufficient at the developing zone.

SUMMARY OF THE INVENTION

Accordingly, it is a principal object of the present invention to provide a developing apparatus wherein the above described drawbacks of the conventional apparatus are eliminated.

It is another object of the present invention to provide a developing apparatus wherein a good quality of developed images can be provided with the use of a small diameter developer carrying member cylinder.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
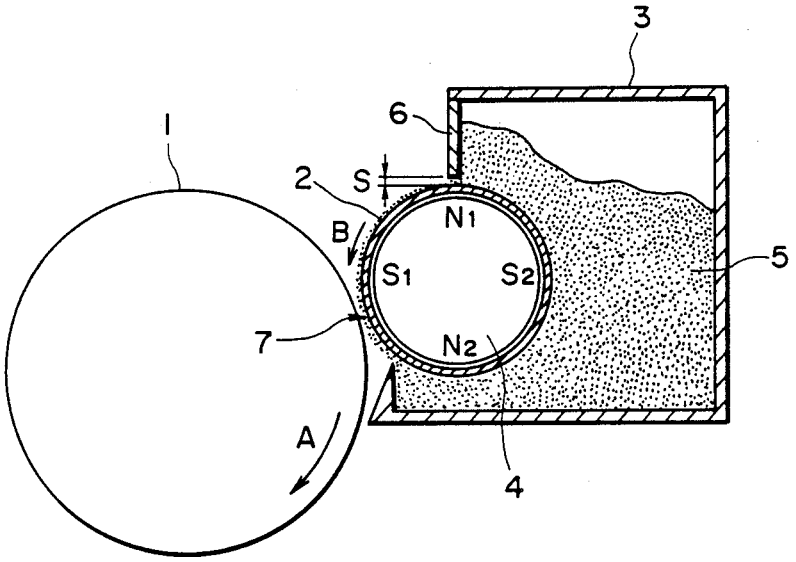
FIG. 1 PRIOR ART
FIG. 1 is a cross-sectional view of a conventional developing apparatus.
Figure 2:
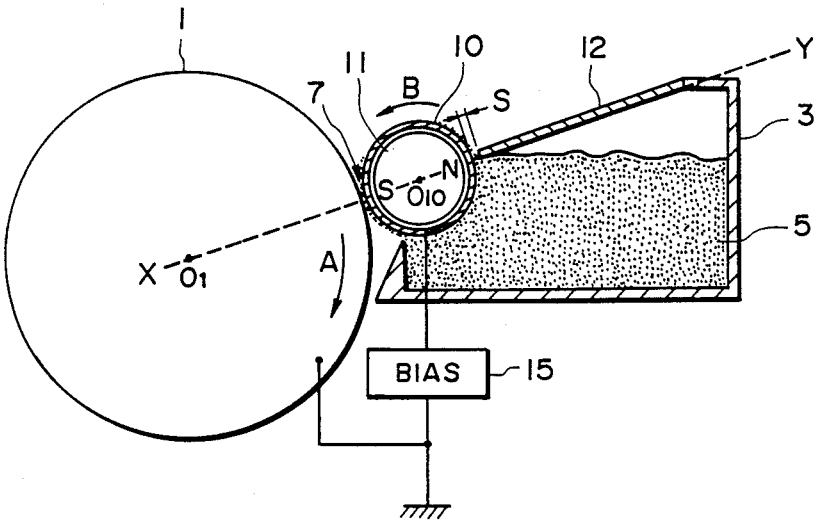
FIG. 2 is a cross-sectional view of a developing apparatus according to an embodiment of the present invention.

Referring to FIG. 2, there is shown a developing apparatus according to a first embodiment of the present invention, wherein a photosensitive drum 1 has a diameter not more than 120 mm, preferably, not more than 60 mm.

The developing apparatus includes a developing sleeve 10 in the form of a cylinder and made of non-magnetic material, and preferably having an outer diameter of not less than 6 mm and not more than 20 mm, and preferably having a thickness of not less than 0.25 mm and not more than 1.5 mm. Further preferably, in order to further assure prevention of scattering or the like of the developer 5, the outer diameter of the developing sleeve 10 is preferably not less than 8 mm and not more than 16 mm.

However, the outer diameter of the developing sleeve 10 may be within the range of not less than 5 mm and not more than 25 mm. To the developing sleeve 10, an alternating voltage is applied upon developing operation by a bias voltage source 15. By the application of the bias voltage, a vibratory electric field is formed so that an electric field in the direction from the sleeve 10 to the drum 1 and the electric field in the direction from the photosensitive drum 1 to the sleeve 10 are produced alternately in the developing zone 7. By the vibratory electric field, the developer makes a vibratory motion in the developing zone 7, whereby the developer is deposited on the image area of the latent image.

A stationary magnetic field generating means is contained in the developing sleeve 10 and is in the form of a permanent magnet or an electromagnet. The magnetic field generating means 11 is, in this embodiment, a columnar magnet 11 having only one couple of magnetic poles N and S having different magnetic poles disposed adjacent to an outer periphery thereof. The magnetic poles N and S are diametrically opposed, that is, the magnetic poles N and S and the rotational center of the developing sleeve 10 are on a rectilinear line. The magnet 11 may be produced in a conventional manner. For example, it may be formed as an integral magnet having only two magnetic poles N and S. As an another alternative, two magnets may be adhered so that the magnetic poles having different polarities are remote from and opposed to each other. As a further alternative, two cut-away portions are formed in a magnet supporting member, and two magnets are mounted in the cut-away portions so that the magnetic poles having different polarities are disposed remote from and opposed to each other. In any case, the magnetic pole N and the magnetic pole S are disposed diametrically opposed with respect to the center of the sleeve 10 and on the outer surface of the magnet 11 concentrically disposed with the sleeve 10. With this arrangement of the two magnetic poles, the diameter of the sleeve 10, and therefore, the diameter of the magnet 11 can be reduced without loosing the strong magnetic force property of the magnet 11. Therefore, strong magnetic field can be produced on the outer periphery of the sleeve 10, despite the small diameters thereof. The clearance between the magnet 11 and the sleeve 10 is not less than 0.25 mm and not more than 1 mm.

One of the magnetic poles of the magnet 11, the magnetic pole N, for example, is disposed at a position opposite to the developing zone 7 and substantially on an extension line XY of a line connecting a rotational center $O_1$ of the photosensitive drum 1 and a rotational center $O_{10}$ of the developing sleeve 10. The other magnetic pole, that is, the magnetic pole S is disposed directly opposed to the developing zone 7 and substantially on the line XY. Thus, the magnetic pole S forms, in the developing zone 7, a magnetic field for erecting magnetic brush of the magnetic developer. Opposed to the magnetic pole N, there is disposed a regulating member 12. The regulating member 12 is disposed on or adjacent the extension of a line connecting the rotational center $O_1$ of the photosensitive drum 1 and the rotational center $O_{10}$ of the developing sleeve 10. One end of the regulating member 12 is mounted on the container 3, and the other end is spaced from the outer surface of the developing sleeve 10 with a predetermined gap S. That end of the regulating member 12 which is opposed to the sleeve 10 is within the magnetic field formed by the magnetic pole N, and therefore, the regulating member 12 is effective to form a thin layer of the developer in the magnetic field. If the regulating member 12 is made of a magnetic material such as iron, the magnetic field is concentrated on the regulating member 12, so that a magnetic curtain is formed in the gap S by a strong magnetic field, so that a developer layer having a thickness quite smaller than the clearance S can be formed.

As an example of the electrostatic latent image to be developed, a latent image constituted by a non-image portion of approximately −200 V and an image portion of approximately −700 V is formed on the photosensitive drum 1. The gap in the developing zone between the surface of the photosensitive drum 1 and the surface of the developing sleeve 10 is 300 microns. The developing bias applied to the developing sleeve 10 is a combined AC voltage having a peak-to-peak voltage of approximately 1.3 KV and having a frequency of 1.5 KHz and a DC voltage of −250 V. A thickness of the developer layer formed on the outer surface of the developing sleeve 10 is approximately 70–80 microns. The outer diameter of the developing sleeve is approximately 10 mm, for example, and the magnetic force of the magnet 11 is so selected that it is 700 Gauss at each of the magnetic poles S and N on the outer surface of the developing sleeve 10. The distance from the outer surface of the magnet 11 to the outer surface of the developing sleeve 10 is approximately 1.2 mm. Since the thickness of the developing sleeve 10 is 0.75 mm, the clearance between the outer surface of the magnet 11 and the inner surface of the developing sleeve 10 is approximately 0.45 mm.

The magnetic force provided by the two-pole magnet 11 acts strongly on the outer surface of the developing sleeve 10 in the developing zone 7, so that the magnetic brush of the developer 5 strongly erects, and therefore, the developer is easily released from the sleeve 10 under the influence of the vibratory electric field, thus increasing the development efficiency. In addition, since the diameter of the developing sleeve 10 is small, a strong magnetic field for conveying the developer is formed on the surface of the sleeve, so that the developer 5 is sufficiently conveyed into the developing zone 7. For those reasons, a good quality image having a high image density can be provided without a foggy background. Furthermore, since the diameter of the developing sleeve 10 is small, the developing zone 7 is limited to the area where the photosensitive drum, and the developing sleeve 10 is closest and in the close neighborhood thereof, whereby an image having a good faithfullness in the half-tone image can be produced.

In the foregoing embodiment described with FIG. 2, a one component developer has been used, but in the following embodiment, two component developer 13 is used which contains magnetic carrier particles and nonmagnetic toner particles.

Figure 3:
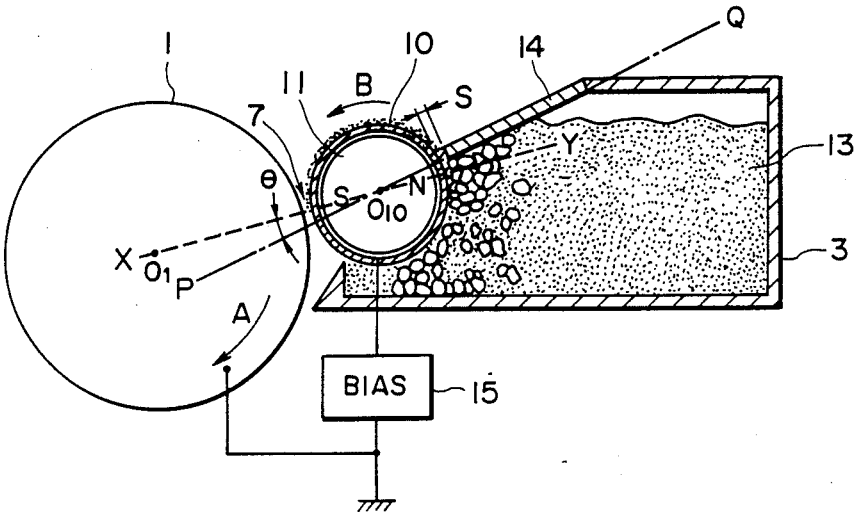
FIG. 3 is a cross-sectional view of a developing apparatus according to another embodiment of the present invention.

Referring to FIG. 3, this embodiment is shown. In this embodiment, the two component developer 13 contains magnetic carrier particles made of, for example, ferrite having a particle size of approximately 70–50 microns coated with silicone resin, and nonmagnetic toner particles made of, for example, toner particles having an average particle size of approximately 10 microns and 0.6% of colloidal silica, the toner particles being made of 100 parts of styrene-butadiene copolymer resin and 5 parts of copper phthalocyanine pigment. When the sleeve 10 rotates, the carrier particles flow adjacent the surface of the sleeve 10 in the container 3, whereby toner particles are conveyed on the sleeve 10 in the container 3.

A regulating member 14 is disposed substantially on a line PQ which is away from the extension XY toward the downstream in the direction of the rotation of the developing sleeve 10 by an angle $\theta$ (approximately 15 degrees) as viewed from the center $O_{10}$ of the sleeve 10. The regulating member 14 has one end mounted to the container 3 and the other end disposed within the magnetic field provided by the magnetic pole N and spaced from the surface of the developing sleeve 10 by a predetermined clearance S, whereby the amount of the toner particles 13 conveyed out of the container is regulated properly and prevents the toner scattering and the production of foggy background. To the developing sleeve 10, a developing bias voltage is applied from the voltage source 15. The bias voltage is, for example, a combination of an alternating voltage having a frequency of 1.6 KHz and a peak-to-peak voltage of approximately 1.3 KV and a DC voltage of approximately −250 V. Due to the strong magnetic field provided by the magnetic pole S in the developing zone 7, the magnetic brush of the developer is sufficiently erected, and therefore, the toner particles are easily released from the carrier particles under the influence of the vibratory electric field, the toner particles are easily released from the carrier particles. For those reasons, a good quality image with a high density can be produced without foggy background.

The angle $\theta$ formed between the line PQ connecting that end of the regulating member 14 which is opposed to the sleeve 10 and the center $O_{10}$ of the sleeve and the downstream line XY with respect to the rotational direction of the sleeve 10, is preferably not less than 5 degrees and not more than 20 degrees. If the angle $\theta$ is close to 5 degrees, the confining force to the magnetic carrier particles provided by the magnetic field becomes strong at the position of the regulating member 14, thus increasing the ratio of the toner to the carrier particles in the developer carried to the developing zone 7, whereas if the angle $\theta$ is close to 20 degrees, the ratio of the toner in the developer conveyed on the sleeve 10 to the developing zone 7 decreases. The regulating member 14 may be made of magnetic material or non-magnetic material, or may be made of magnetic material and non-magnetic material overlaid one another.

The present invention is applicable to the apparatus wherein the sleeve 10 is supplied with a DC voltage from a voltage source 15, wherein a DC electric field is formed in the developing zone 7. In this case, it is preferable that the clearance S is larger so that the magnetic brush of the developer erected from the surface of the sleeve in the developing zone 7 is contacted to the surface of the drum 1.

As for the two component developer, a mixture of magnetic carrier particles and weakly magnetic toner particles can be used.

Also, the present invention is applicable to a contact type developing apparatus wherein the developing sleeve surface is contacted to the photosensitive drum in the developing zone, as disclosed, for example, in U.S. Pat. No. 4,444,864 and Japanese Laid-Open patent application No. 91168/1979.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a rotatable cylindrical member, disposed opposed or contacted to an image bearing member in a developing zone, for carrying a developer thereon to the developing zone to supply the developer to the image bearing member;

magnetic field generating means stationarily disposed in said cylindrical member, said magnetic field generating means including only two magnetic poles adjacent outer periphery thereof, said two magnetic poles being substantially on a line passing through a center of said cylindrical member, wherein one of said magnetic poles forms a magnetic field in the developing zone;

means for supplying a developer on said cylindrical member; and regulating means for regulating a thickness of a developer layer formed on said cylindrical member, wherein said regulating member is disposed in a magnetic field formed by the other magnetic pole.

2. An apparatus according to claim 1, wherein said image bearing member is in the form of a drum, and said two magnetic poles are substantially on a line connecting a center of said image bearing member and the center of said cylindrical member.

3. An apparatus according to claim 1 or 2, further comprising means for applying a bias voltage for forming a vibratory electric field between the image bearing member and said cylindrical member.

4. An apparatus according to claim 1 or 2, wherein said regulating means is of magnetic material, and said supplying means supplies a one component developer to said cylindrical member.

5. An apparatus according to claim 1 or 2, wherein said supplying means supplies a developer containing magnetic carrier particles and toner particles to said cylindrical member, and wherein said regulating means is disposed at such a position that a line connecting the center of said cylindrical member and said regulating means is away from said line passing through the center of said cylindrical member by not less than 5 degrees and not more than 20 degrees.

6. An apparatus according to claim 1 or 2, wherein said cylindrical member has a diameter not less than 6 mm and not more than 20 mm.

7. An apparatus according to claim 6, further comprising means for applying a bias voltage for forming a vibratory electric field between the image bearing member and said cylindrical member.

8. An apparatus according to claim 6, wherein said regulating means is of magnetic material, and said supplying means supplies a one compartment developer to said cylindrical member.

9. An apparatus according to claim 6, wherein said supplying means supplies a developer containing magnetic carrier particles and toner particles to said cylindrical member, and wherein said regulating means is disposed at such a position that a line connecting the center of said cylindrical member and said regulating means is away from said line passing through the center of said cylindrical member by not less than 5 degrees and not more than 20 degrees.

* * * * *

UNITED STATES PATENT AND TRADEMARK OFFICE

CERTIFICATE OF CORRECTION

PATENT NO. : 4,929,981

DATED : May 29, 1990

INVENTOR(S) : TAKAHIRO KUBO, ET AL.

It is certified that error appears in the above-identified patent and that said Letters Patent is hereby corrected as shown below:

ON TITLE PAGE:

IN [56] REFERENCES CITED

U.S. PATENT DOCUMENTS, "3,923,034 1/1976 Takahashi" should read --3,932,034 1/1976 Takahashi--.

COLUMN 6

Line 42, "one compartment developer" should read --one component developer--.

Signed and Sealed this

Twenty-third Day of June, 1992

*Attest:*

DOUGLAS B. COMER

*Attesting Officer*

*Acting Commissioner of Patents and Trademarks*